US007975381B2

(12) United States Patent
Drouillard

(10) Patent No.: US 7,975,381 B2
(45) Date of Patent: Jul. 12, 2011

(54) VALVE OPERATING CAMSHAFT SYSTEM FOR INTERNAL COMBUSTION ENGINE

(75) Inventor: Darrell Charles Drouillard, Tecumesh (CA)

(73) Assignee: Ford Global Technologies, Dearborn, MI (US)

( * ) Notice: Subject to any disclaimer, the term of this patent is extended or adjusted under 35 U.S.C. 154(b) by 503 days.

(21) Appl. No.: 12/207,614

(22) Filed: Sep. 10, 2008

(65) Prior Publication Data

US 2010/0059002 A1 Mar. 11, 2010

(51) Int. Cl.
*B21D 53/84* (2006.01)

(52) U.S. Cl. ..... 29/888.1; 123/90.6

(58) Field of Classification Search ..... 29/888.1; 123/90.6; 74/567
See application file for complete search history.

(56) References Cited

U.S. PATENT DOCUMENTS

| | | | | |
|---|---|---|---|---|
| 5,421,292 | A | | 6/1995 | Hoffman et al. |
| 5,435,281 | A | | 7/1995 | Regueiro |
| 5,564,374 | A | | 10/1996 | Hoffman et al. |
| 5,651,337 | A | * | 7/1997 | Regueiro ..... 123/90.27 |
| 5,682,849 | A | | 11/1997 | Regueiro |
| 2007/0240671 | A1 | | 10/2007 | Imazato et al. |
| 2008/0141960 | A1 | | 6/2008 | Rohe et al. |

* cited by examiner

*Primary Examiner* — Zelalem Eshete
(74) *Attorney, Agent, or Firm* — Jerome R. Drouillard; Julia Vouytras

(57) ABSTRACT

A camshaft system includes a number of cam lobes locked upon a cylindrical shaft. Bearings configured with one-piece bores and are engaged with the cylindrical shaft. The bearings are captured upon the shaft by the locked-on cam lobes.

7 Claims, 4 Drawing Sheets

VALVE OPERATING CAMSHAFT SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to a camshaft for operating cylinder intake and exhaust poppet valves in an internal combustion engine.

2. Related Art

Contemporary internal combustion engines often include multiple camshafts. For example, V-type engines using overhead camshafts frequently include up to four such camshafts. Needless to say, the provision of multiple camshafts requires a good deal of machining in traditional engines because the camshafts are typically mounted upon towers which are cast into the engine cylinder heads, with each of the towers being first machined to accept a cap, which is constructed separately. The caps are applied to the towers and the tower and cap assembly is bored to allow mounting of a camshaft. The removable caps of such bearing towers are typically held in place by machine screws which must be properly torqued to provide an adequate bearing surface for the camshaft. Moreover, a tendency toward excessive tower porosity during the casting process makes the casting of cylinder heads with integral towers difficult. Another problem resides in the fact that bolted-on caps tend to distort the camshaft mounting bore, contributing to excess friction and in some cases, premature loss of engine oil pressure.

It would be desirable to provide a camshaft having completely unitary one-piece bearings held captive in an assembly, including a camshaft, which may be bolted to a cylinder head during an engine manufacturing process.

SUMMARY OF THE INVENTION

A camshaft for an internal combustion engine includes a cylindrical shaft and a number of cam lobes locked upon the shaft. A number of bearings, configured with one-piece bores, are engaged with the cylindrical shaft. At least one of the bearings is retained upon the cylindrical shaft by adjacent ones of the cam lobes. This retention amounts to a capturing of the bearings upon the cylindrical shaft, because the cam lobes are rotationally, but more importantly, axially locked, upon the cylindrical shaft.

The cylindrical shaft has a generally cylindrical outer surface with a generally uniform outside diameter. A drive member, such as a chain sprocket, or a toothed pulley suitable for driving by a fabric-reinforced belt, is attached to an end of the cylindrical shaft.

The cam lobes may be locked to the cylindrical shaft either by locally roughening regions on the camshaft, followed by pressing each cam lobe onto the locally roughened regions. Alternatively, the cam lobes may be locked to cylindrical shaft by welding, or by use of cryogenic shrinking of the cylindrical shaft. If a cryogenic assembly process is employed, the cylindrical shaft will be chilled and reduced in diameter sufficient to allow the cam lobes to be positioned, followed by allowing the cylindrical shaft to warm sufficiently to lock the cam lobes in place.

According to another aspect of the present invention, a method for fabricating a camshaft for an internal combustion engine includes roughening a first retention portion of the outside surface of a generally cylindrical shaft, followed by pressing a first cam lobe upon the first retention portion of the shaft, such that the first cam lobe is rotationally and axially locked upon the shaft. Then, a shaft mounting bearing having a one-piece shaft engaging bore is slidably engaged with the shaft, with the shaft bearing being positioned adjacent to the first cam lobe. Thereafter, a second retention portion of the outside surface of the shaft is roughened, with the second retention portion being placed such that the shaft mounting bearing is between the first and second retention portions. Then, a second cam lobe will be pressed upon the second retention portion of the shaft. This system advantageously uses cam lobes with bores having an inside diameter which permits each of the cam lobes to slide over at least a third portion of the shaft extending outside the first and second retention portions. The roughened first and second retention portions each have an outside diameter which is greater than the outside diameter of an unroughened portioned of the generally cylindrical shaft, and indeed, greater than the inside diameter of the bores in the cam lobes.

In a more general sense, according to the present invention, a method for fabricating a camshaft for an internal combustion engine includes fastening a first cam lobe upon a first retention portion of a generally cylindrical shaft having a generally uniform outside diameter, such that the first cam lobe is rotationally and axially locked upon the shaft. Then, a shaft mounting bearing tower is slidably engaged with the shaft. The shaft mounting bearing tower has a one-piece shaft engaging bore. The bearing is engaged so that the shaft mounting bearing tower is positioned adjacent the first cam lobe. Then, a second cam lobe is fastened upon a second retention portion of the shaft such that the shaft mounting bearing tower is captured between the first and second retention portions.

It is an advantage of a camshaft according to the present invention that the machining and construction of an overhead camshaft cylinder head may be simplified and rendered available at a reduced cost, as compared with conventional overhead camshaft systems.

It is another advantage of a camshaft system according to the present invention that the camshaft operates with lower running friction, thereby consuming less power from the engine.

It is another advantage of a camshaft system according to the present invention that maintenance of an engine may be readily facilitated, because excessively worn camshaft and bearing units may be unbolted and lifted off the cylinder head as a unit, whereas with cast-in-place camshaft towers, repair of the towers is frequently not possible, because bearing inserts are not employed, and as a result, excessively worn parent metal bores may necessitate replacement of the cylinder head.

Other advantages, as well as features of the present invention, will become apparent to the reader of this specification.

DETAILED DESCRIPTION OF THE PREFERRED EMBODIMENTS

Figure 1:
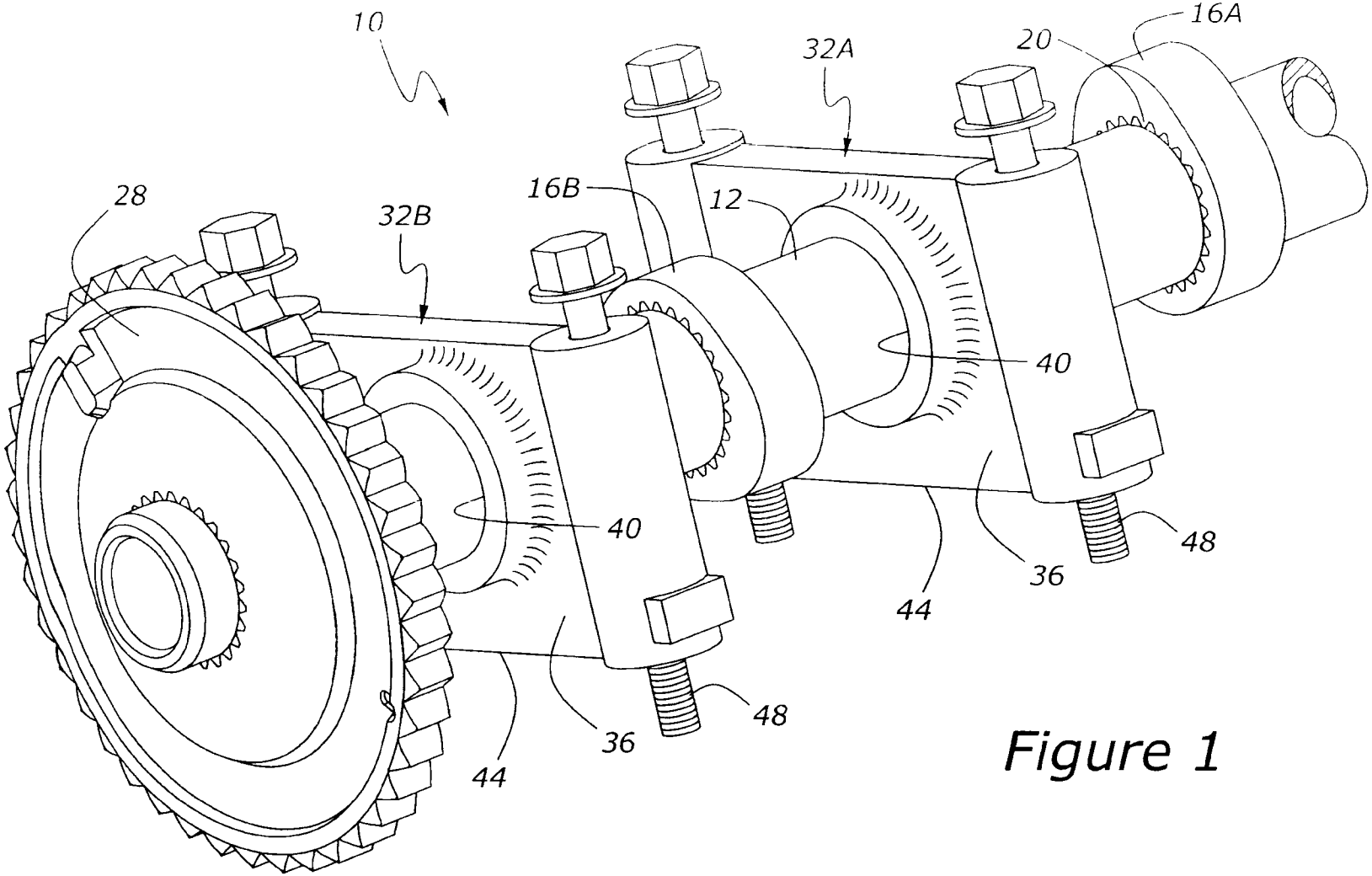
FIG. 1 is a perspective view of a camshaft system according to an aspect of the present invention.

As shown in FIG. 1, a camshaft system, 10, includes a cylindrical shaft, 12. Shaft 12 has a generally cylindrical outer surface 12 which has a generally uniform outside diameter. The outside diameter of shaft 12 is preferably uniform because this permits various components to be slidably engaged with shaft 12 during fabrication of camshaft system 10. The uniform outside diameter is further important because each of the bearings 32 (two are shown, namely 32A and 32B) must be sized to allow sliding upon shaft 12 merely because the bearings have no caps for opening the bearing bores as consequence of the bores being one-piece, as described below.

Figure 2:
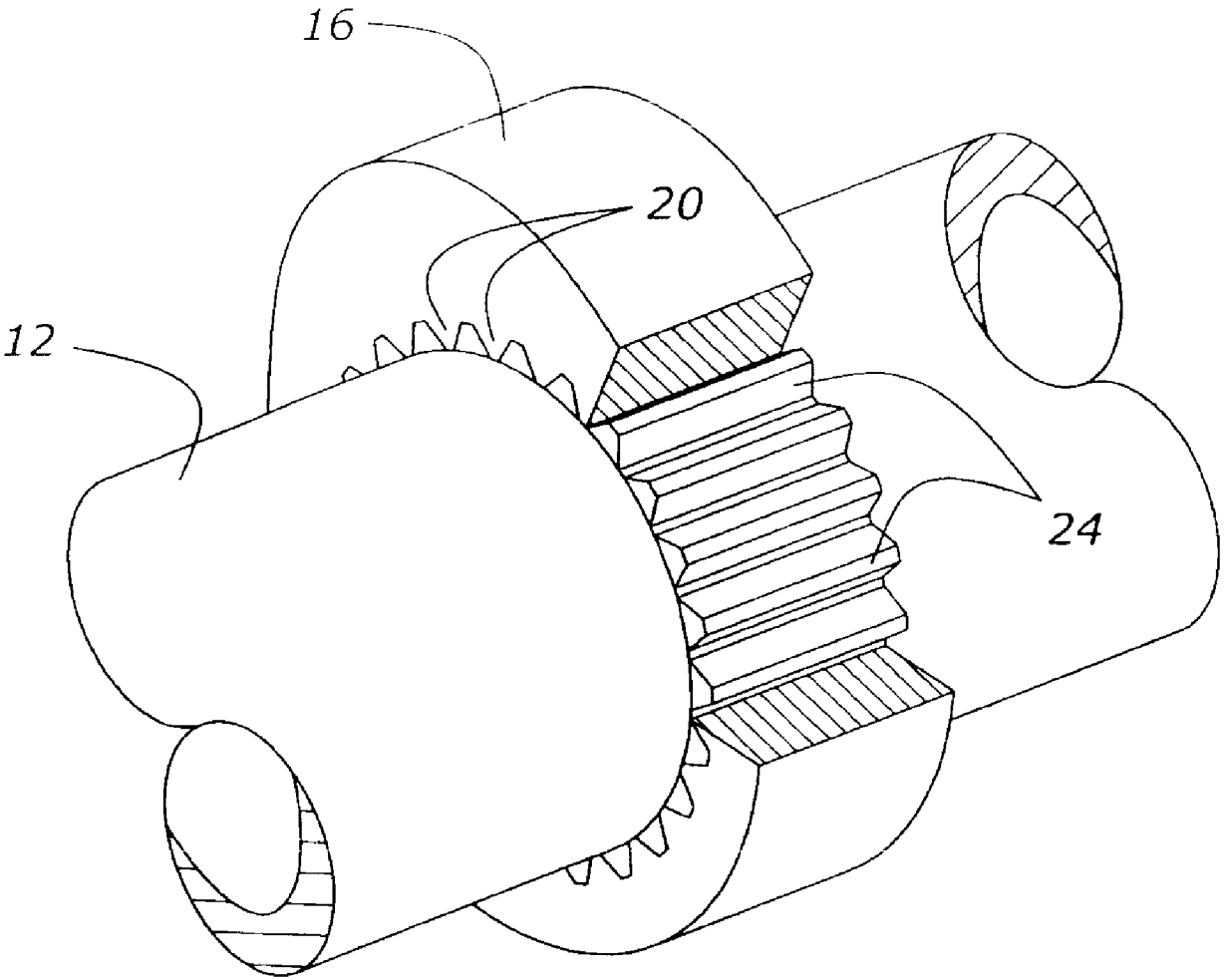
FIG. 2 is a perspective view of a portion of the camshaft system shown in FIG. 1.

Camshaft system 10 has a number of cam lobes 16, which are locked upon cylindrical shaft 12 either mechanically, or by welding, or by cryogenic bonding. FIGS. 1 and 2 show cam lobes 16 which are mechanically joined to cylindrical shaft 12 by locally roughened sections. Thus, as particularly shown in FIG. 2, a number of serrations, 20, are formed on an inside diameter of a bore through cam lobe 16 and a number of serrations, 24, are formed on the outside diameter of shaft 12. Serrations 24 located within the mid-portion of shaft 12 are applied to shaft 12 after an adjacent one of bearings 32 has been moved onto shaft 12. Returning to FIG. 1, it is seen that camshaft lobe 16A could be applied to cylindrical shaft 12 first, followed by slidably engaging bearing 32A or placing bearing 32A upon shaft 12, followed by localized roughening of a second retention portion of shaft 12, so as to permit lobe 16B to be pressed in place upon shaft 12. Then, bearing 32B can be slidably engaged with shaft 12, followed by localized roughening of shaft 12 to permit drive sprocket 28 to be pressed upon shaft 12, with the result that drive sprocket 28, as well as cam lobe 16A and cam lobe 16B are all rotationally and axially locked upon shaft 12. However, bearings 32A and 32B will be free to slide along a portion of shaft 12 to the appropriate position for each of the bearings to be bolted in place by means of fasteners 48 upon a cylinder head (not shown). The region in which each of bearings 32 is slidably movable on shaft 12 is limited by the placement of cam lobes 16 or sprocket 28, in combination with one of cam lobes 16.

As further shown in FIG. 1, bearings 32 each include a tower portion, 36, and a base, 44. Each base 44 engages a cylinder head (not shown) of an engine and allows the bearing 32A or 32B to be securely mounted to the cylinder head. Those skilled in the art will appreciate in view of this disclosure, moreover, that the number of cam lobes and bearings used with any particular camshaft arrangement may be selected to provide a functional camshaft supported in a sufficiently robust fashion to perform the function as intended.

Figure 3:
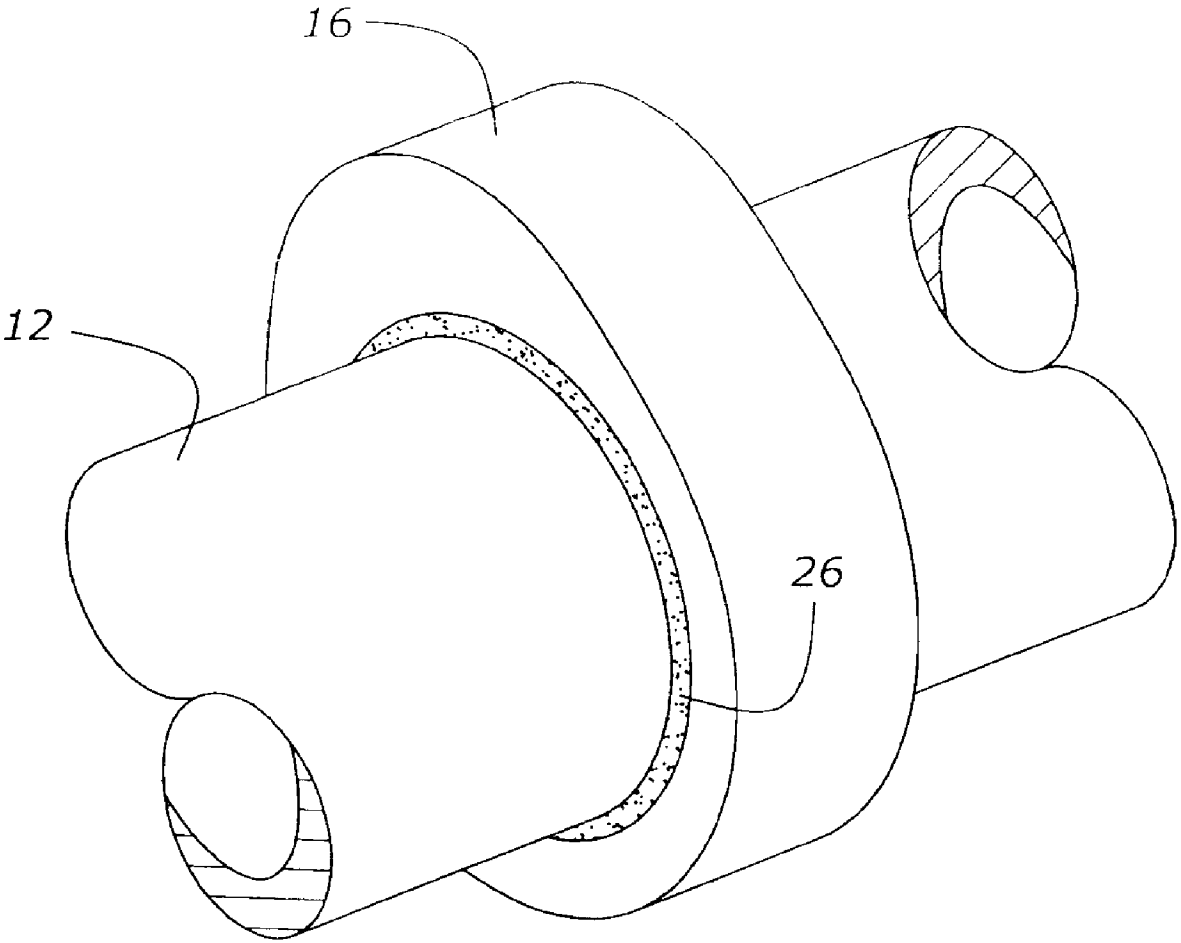
FIG. 3 is similar to FIG. 2 but shows a camshaft having a welded cam lobe.

In the event that it is desired to assemble the camshaft system shown with cryogenic techniques, shaft 12 may first be brought to a very low temperature such as through submergence in liquid nitrogen, for example, followed by slidably engaging the various components, namely cam lobes 16 and bearings 32, followed by indexing cam lobes 16 to the appropriate axial and rotational positions, followed by allowing the cryogenically shrunken cylindrical shaft 12 to warm sufficiently to lock cam lobes 16 in their desired orientations. As yet another alternative, cam lobes 16 may, as shown in FIG. 3, be welded to shaft 12. Weld 26 is shown as securing lobe 16 to shaft 12.

Figure 4:
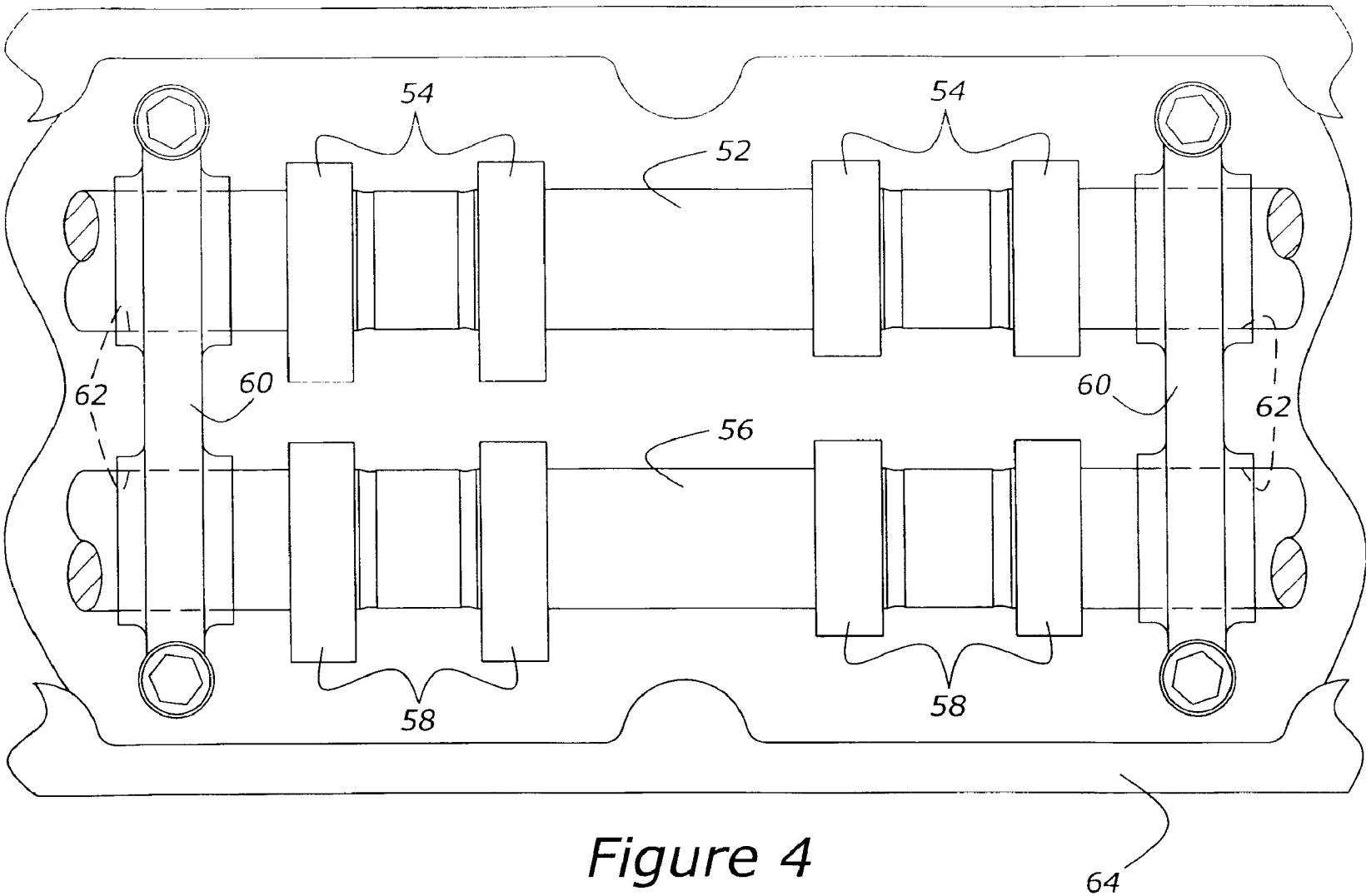
FIG. 4 is a plan view of a double overhead camshaft arrangement according to an aspect of the present invention.

FIG. 4 illustrates an embodiment according to the present invention in which two camshafts, 52 and 56, having cam lobes 54 and 58, respectively, are attached to a cylinder head, 64, by bearings 60. Each of bearings 60 has two bores, 62, which function in the manner of bearings 32, to permit rotation of camshafts 52 and 56. Bearings 60 are bolted to cylinder head 64 by fasteners 68.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A method for fabricating a camshaft system for an internal combustion engine, comprising:

roughening a first retention portion of the outside surface of a generally cylindrical shaft;

pressing a first cam lobe upon said first retention portion of said shaft, such that said first cam lobe is rotationally and axially locked upon said shaft;

slidably engaging a shaft mounting bearing, having a one-piece shaft engaging bore, with said shaft, so that the shaft mounting bearing is positioned adjacent said first cam lobe;

roughening a second retention portion of the outside surface of said shaft, with said second retention portion being placed such that said shaft mounting bearing is between the first and second retention portions; and pressing a second cam lobe upon said second retention portion of said shaft.

2. A method according to claim 1, wherein each of said cam lobes has a bore with an inside diameter which permits each of the cam lobes to slide over at least a third portion of the shaft extending outside of said first and second retention portions.

3. A method according to claim 1, wherein the roughened first and second retention portions of the generally cylindrical shaft each has an outside diameter which is greater than the outside diameter of an unroughened portion of the generally cylindrical shaft.

4. A method for fabricating a camshaft system for an internal combustion engine, comprising:

fastening a first cam lobe upon a first retention portion of a generally cylindrical shaft having a generally uniform outside diameter, such that said first cam lobe is rotationally and axially locked upon said shaft;

slidably engaging a shaft mounting bearing tower, having a one-piece shaft engaging bore, with said shaft, so that the shaft mounting bearing tower is positioned adjacent said first cam lobe; and fastening a second cam lobe upon a second retention portion of said shaft, such that said shaft mounting bearing tower is captured between the first and second retention portions.

5. A method according to claim 4, wherein said first cam lobe and said second cam lobe are fastened upon said generally cylindrical shaft by welding.

6. A method according to claim 4, wherein said first cam lobe and said second cam lobe are fastened upon said generally cylindrical shaft by temporarily shrinking said shaft cryogenically and by providing cam lobes having bores which slidably fit the cryogenically shrunk shaft.

7. A method according to claim 4, wherein said first cam lobe and said second cam lobe are fastened upon said generally cylindrical shaft by mechanical joints.

* * * * *